US005328405A

United States Patent [19]

Jarnot

[11] Patent Number: 5,328,405

[45] Date of Patent: Jul. 12, 1994

[54] VENTILATOR WITH DECK MOUNT

[76] Inventor: Frank R. Jarnot, P.O. Box 3494, Lantana, Fla. 33465

[21] Appl. No.: 7,106

[22] Filed: Jan. 22, 1993

[51] Int. Cl.[5] ..... F24F 7/00

[52] U.S. Cl. ..... 454/78; 454/275

[58] Field of Search ..... 454/78, 79, 82, 118, 454/275, 276

[56] References Cited

U.S. PATENT DOCUMENTS 3,524,400 8/1970 Magi ..... 454/78

3,892,169 7/1975 Jarnot .

4,050,363 9/1977 Fuerst ..... 454/78

*Primary Examiner*—Harold Joyce

*Attorney, Agent, or Firm*—Jacobson, Price, Holman & Stern

[57] ABSTRACT

An annular vent assembly is provided for securement over one side of a panel having a vent opening therethrough. The vent assembly is equipped with a readily removable and rotatably supported incident wind scoop as well as alternately usable perforated and imperforate closures capable of enjoying weather tight connections with the vent assembly. Also, the vent assembly includes a semipermanently mounted annular base assembly from which all other components of the vent assembly may be readily removed.

7 Claims, 1 Drawing Sheet

VENTILATOR WITH DECK MOUNT

BACKGROUND OF THE INVENTION

1. Field of the Invention

This invention relates to an improvement on my prior cover equipped flexible panel vent disclosed in U.S. Pat. No. 3,892,169 and incorporates a rigid surface mount therefore, an alternate solid closure and retaining tabs for the rotatable scoop to prevent accidental dislodgement thereof.

2. Description of Related Art

The ventilator of the instant invention comprises an improvement over the vent disclosed in my prior U.S. Pat. No. 3,892,169 and incorporates additional structure whereby the vent may be mounted from a rigid panel by conventional fasteners, wherein an alternate solid closure is provided therefore and whereby the wind scoop or hood is equipped with retaining tabs preventing unintentional dislodgement thereof.

The main object of this invention is to provide a readily installed vent for a solid panel having a vent opening therein.

Another object of this invention is to provide a vent construction incorporating an alternate solid closure for the vent passage extending therethrough.

Yet another important object of this invention is to provide the vent with a rotatably adjustable wind scoop equipped with retaining tabs preventing accidental dislodgement thereof.

Still another very important object of this invention is to provide a ventilator or vent construction in accordance with the preceding objects and which may be rendered substantially weatherproof.

A final object of this invention to be specifically enumerated herein is to provide a vent construction in accordance with the preceding objects and which will conform to conventional forms of manufacturer, be of simple construction and easy to use so as to provide a device that is economical feasible, long lasting and relatively trouble free in operation.

These together with other objects and advantages which will become subsequently apparent reside in the details of construction and operation as more fully hereinafter described and claimed, reference being had to the accompanying drawings forming a part hereof, wherein like numeral refer to like parts throughout.

DESCRIPTION OF THE PREFERRED EMBODIMENT

Figure 1:
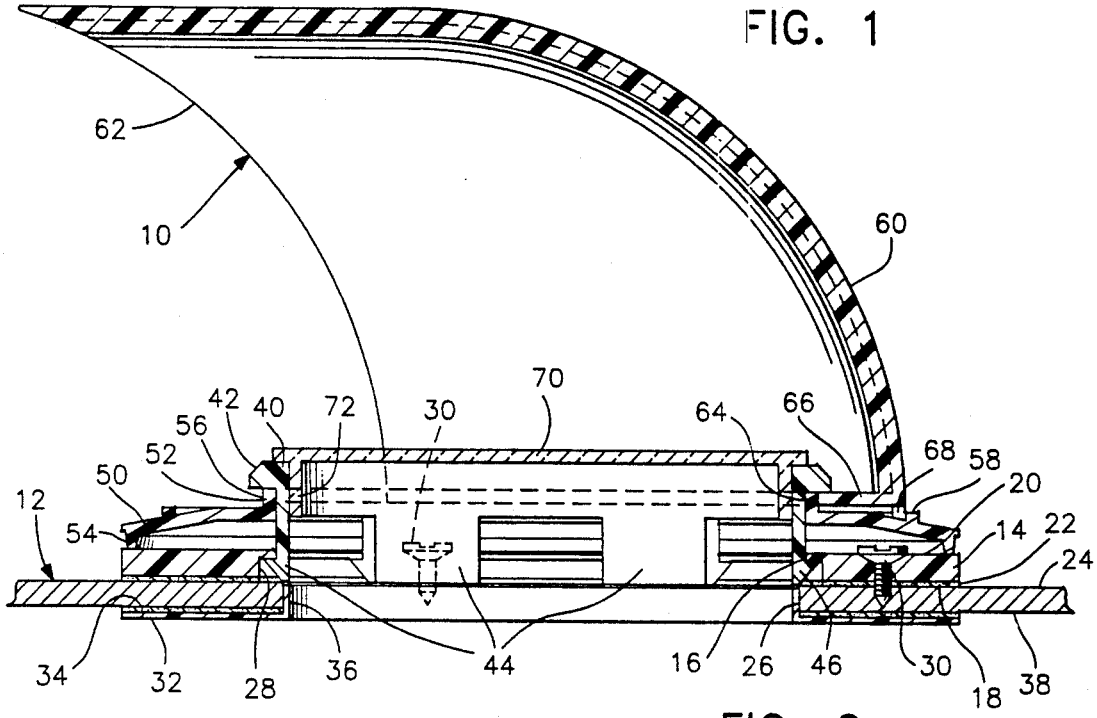
FIG. 1 is an enlarged vertical sectional view taken substantially upon a plane passing through the center of the ventilator.
Figure 2:
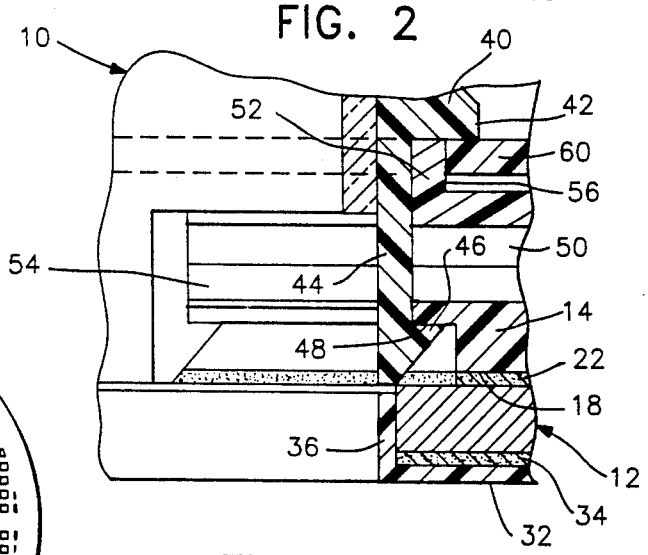
FIG. 2 is a fragmentary enlarged vertical sectional view of the lower right hand portion of FIG. 1.
Figure 4:
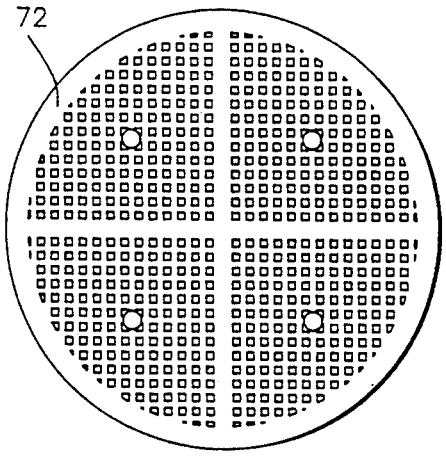
FIG. 4 is a top plan view of a foraminated closure for the vent construction to be used in lieu of the solid closure therefor illustrated in FIG. 1.
Figure 3:
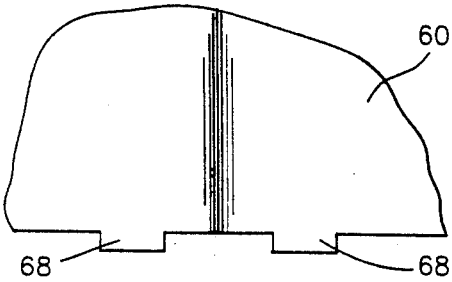
FIG. 3 is a rear elevational view of the lower portion of the hood of the vent illustrating the locking tabs therefore.

Referring now more specifically to the drawings the numeral 10 generally designates the ventilator of the instant invention which is illustrated in FIGS. 1 and 2 in operative association with the exterior of a solid panel referred to in general by the reference numeral 12.

The ventilator or vent scoop construction 10 includes an annular base assembly 14 defining a vent opening 16 therethrough and including first and second sides 18 and 20. The first side 18 is equipped with a layer of sealing material 22 and is adapted to be supported from and disposed in reasonably good sealed relation with one surface 24 of the panel 12 in alignment with a ventilation opening 26 formed therethrough.

The vent opening 16 includes a counter bore 28 opening through the first surface 18 and threaded fasteners 30 may be secured downwardly through the annular base assembly 14 at points spaced thereabout and threadingly engaged in the panel 12. Still further, an annular interior face plate 32 is provided and equipped with an adhesive coating 34 as well as an inner peripheral cylindrical flange 36. The face plate 32 is displaced upwardly into contact with the under surface 38 of the panel 12 about the ventilation opening 26 and with the cylindrical flange 36 projecting upwardly into and substantially through the ventilation opening 36, the adhesive coating 34 maintaining the face plate in position.

Forming a removable part of the annular base assembly 14 there is provided a sleeve 40 having an outwardly projecting circumferential flange 42 on one end and defining a plurality of axially extending integral spring arms or tab member 44 based thereabout on its opposite axial end. The arms 44 are stiff but slightly flexible and resilient and include outwardly projecting outer end abutments 46. The arms 44 flex inwardly for reception through the vent opening 16 and then flex back out to engage the projections 46 beneath the shoulder 48 defined at the inner end of the counter bore 28.

Also, the base assembly includes an annular member 50 which is snugly received over the sleeve 40 inward of the flange 42 and includes an inner peripheral tubular or cylindrical flange or extension 52 which abuts flange 42. The annular member 50 is slightly cupped toward the second surface 20 and includes an outer peripheral cylindrical flange 54 abutted against the surface 20 in reasonably tight sealed engagement therewith.

The flange 42 projects radially outward of the flange 52 in order to define a radially outwardly opening circumferential groove 56 extending about the annular base assembly 14.

The surface of the annular member 50 facing away from the surface 20 includes an axially projecting rib or flange 58 and a hood or scoop member 60 is provided with an inlet opening as at 62 and an outlet opening 64 at the inner periphery of an inturned flange 66 of slightly greater than 180° in angular extent, the hood 60 being constructed of shaped retentitive but slightly resilient material.

The hood 60 may be engaged in the groove 56 by displacing the hood 60 in the direction in which the inlet opening 62 opens relative to the annular base assembly 62 in a manner to engage the flange 66 with the groove 56, the rear side of the hood 60 including a pair of circumferentially spaced, depending tabs or tab members 68 which are snap engageable over the adjacent portion of the flange 58 to releasably lock the hood 60 in rotatably supported engagement in the groove 56 against accidental dislodgement therefrom.

The dimension between the projections 56 and the flange 44 is such that the annular member 50 is slightly flexed to reduce the cup thereof whereby the cylindrical flange 52 tightly engages the flange 44 and the cylindrical flange 54 tightly engages the surface 20 in a waterproof manner.

Thus it may be seen that the hood 60 may be rotated a full 360° about the annular base assembly 14. Further, if it is desired to close the ventilator 10, a solid closure disk 70 is provided and includes a cylindrical flange 72 which may be downwardly telescoped into the interior of the sleeve 40. In addition, a foraminated closure 72 of the same cross sectional shape as the closure 70 may be substituted for the latter in order to allow substantially free circulation of air through the ventilator 10, but to exclude the passage of insects therethrough.

Of course, the ventilator 10 may be used in pairs with one ventilator hood facing in one direction and the other ventilator hood facing in the other direction, thus to create cross flow ventilation between the ventilators inwardly of the panel 12.

The foregoing is considered as illustrative only of the principles of the invention. Further, since numerous modification and changes readily will occur to those skilled in the art, it is not desired to limit the invention to the exact construction and operation shown and described, and, accordingly, all suitable modifications and equivalence may be resorted to, falling within the scope of the invention.

What is claimed as new is:

1. A variable relative wind direction vent scoop construction including a base assembly defining a vent opening therethrough and including first and second sides with said first side being adapted to be supported from and disposed in reasonably good sealed relation with one side of a panel having a ventilation opening formed therethrough with said vent opening in registry with said ventilation opening, said second side including a tubular flange projecting outwardly therefrom generally concentric with said vent opening, said tubular flange defining a circumferential radially outwardly opening groove extending thereabout, and a hollow scoop member constructed of stiff, but slight resilient material and defining inlet and outlet portions opening outwardly in relatively angulated directions, said outlet portion defining a generally semiannular inturned flange extending generally 180° about said outlet portion and opening, generally, in the direction in which said inlet portion opens, said base assembly including a circumferential rib at least generally concentric with said tubular flange projecting slightly outwardly from said second side outwardly of said tubular flange, said scoop member being displacable, generally in said direction in which said inlet portion opens, relative to said base assembly and radially of said groove for releasable engagement of said inturned flange in said groove and rotatable support of said scoop member from said base assembly, the side of said outlet portion opposite said direction including at least one short tab member removably snap engaged over said rib to a position immediately inward thereof to prevent accidental dislodgement of said scoop member from said groove and base assembly.

2. A vent comprising first and second separable annular members each including first and second side faces, said first annular member defining a first central opening therethrough and adapted to have the first side face thereof abut a surface of a panel having a vent opening formed therethrough with said openings in registry, said first annular member including means for securement to said surface, said second member defining a second central opening therethrough, said second annular member including a plurality of arms spaced about the corresponding central opening and projecting outwardly of the second side thereof through the central opening of the first annular member, said arms being stiff, but slightly flexible and resilient and including outwardly projecting outer end abutments releasably overlying opposing surfaces of said first annular member disposed about the central opening thereof facing outwardly of and recessed inwardly of the first side face of said first annular member with said arms and abutments releasably securing said annular members together with said second side faces at least substantially sealed relative to each other about said central openings, and a scoop member mounted from said second annular member and disposed at least substantially entirely outwardly of the first side face thereof for catching incident wind and directing said wind through said openings, said second annular member including an annular flange member snugly telescoped over said arms and including opposite end axial faces with one end face opposing said second side face of said second member and the other axial end face facing outwardly in the direction in which said arms extend, said annular flange member being slightly cupped toward said first member and said second annular member including an outwardly projecting circumferential flange on the second side thereof inwardly of which said annular flange member is disposed, said annular flange member including an axial extension projecting outwardly of the inner periphery thereof toward and abutting said circumferential flange, said circumferential flange and said extension defining a circumferential radially outwardly opening groove therebetween, said scoop member being constructed of stiff but slightly resilient material and defining inlet and outlet portions opening outwardly in relatively angulated directions, said outlet portion defining a generally semi-annular inturned flange extending generally 180° about said outlet portion, said base including a circumferential rib at least generally concentric with said axial extension projecting slightly outwardly from said second side, said scoop member being displacable, generally in said direction in which said inlet portion opens, relative to said base and radially of said groove before releasable engagement of said flange in said groove and rotatable support of said scoop member from said base, the side of said outlet portion opposite said direction including at least one short tab member removably snapped engaged over said rib to a position immediately inward thereof.

3. A vent structure incorporating an annular assembly defining a central opening therethrough and including first and second sides, said assembly being adapted to be secured to a surface having a central opening formed therethrough with said first side at least substantially sealed relative to said surface, said second side defining an inner peripheral, circumferential and radially outwardly opening groove, a hollow scoop member constructed of stiff, but slightly resilient material and defining inlet and outlet portions opening outwardly in relatively angulated directions, said outlet portion defining a generally semiannular inturned flange extending generally 180° about said outlet portion and opening, generally, in the direction in which said inlet portion opens, said annular assembly including a circumferential rib radially outwardly of said groove and at least generally concentric therewith and projecting axially slightly outwardly from said second side, said scoop member being displacable, generally in said direction in which said inlet portion opens, relative to said annular assembly and radially of said groove for releasable engagement of said flange in said groove and rotatable support of said scoop member from said annular assembly, the side of said outlet portion opposite said direction in which said inlet portion opens including at least one short tab member removably snap engaged over said rib to a position immediately inward thereof.

4. The vent structure of claim 3 wherein said inturned flange is of slightly more than 180° in angular extent about said radially outwardly opening groove.

5. The vent structure of claim 3 including a closure disk for said central opening including a reduced diameter axially projecting nipple removeably fictionally received in said vent opening from said second side of said annular assembly.

6. The vent of claim 5 wherein said closure disk is imperforate.

7. The vent structure of claim 5 wherein said closure disk is foraminated.

* * * * *